US006643894B1

(12) United States Patent
Dell

(10) Patent No.: US 6,643,894 B1
(45) Date of Patent: Nov. 11, 2003

(54) HIGH EFFICIENCY VACUUM CLEANING APPARATUS AND METHOD

(76) Inventor: William C. Dell, 3908 Country Club Rd., New Bern, NC (US) 28562

( * ) Notice: Subject to any disclaimer, the term of this patent is extended or adjusted under 35 U.S.C. 154(b) by 23 days.

(21) Appl. No.: 10/085,299

(22) Filed: Feb. 28, 2002

(51) Int. Cl.[7] ..... A47L 5/30; A47L 11/20
(52) U.S. Cl. ..... 15/385; 134/21
(58) Field of Search ..... 15/320, 383, 385; 134/21

(56) References Cited

U.S. PATENT DOCUMENTS

| | | | | | |
|---|---|---|---|---|---|
| 1,267,282 | A | | 5/1918 | Scully | |
| 1,498,255 | A | | 6/1924 | Winchester | |
| 3,624,668 | A | | 11/1971 | Krause | |
| 3,813,726 | A | | 6/1974 | Kowalewski | |
| 4,097,950 | A | | 7/1978 | Satterfield | |
| 4,182,001 | A | * | 1/1980 | Krause | 15/320 |
| 4,333,204 | A | | 6/1982 | Monson | |
| 4,377,018 | A | * | 3/1983 | Cain | 15/322 |
| 4,441,229 | A | * | 4/1984 | Monson | 15/322 |
| 4,692,959 | A | | 9/1987 | Monson | |
| 5,030,410 | A | | 7/1991 | Perry et al. | |
| 5,394,585 | A | | 3/1995 | Connelly | |
| 5,463,791 | A | | 11/1995 | Roden | |
| 5,784,754 | A | | 7/1998 | Roden et al. | |
| 5,839,157 | A | | 11/1998 | Strauser et al. | |
| 6,032,326 | A | | 3/2000 | Roden et al. | |
| 6,105,207 | A | | 8/2000 | Muller | |

* cited by examiner

*Primary Examiner*—Terrence R. Till
(74) *Attorney, Agent, or Firm*—Coats & Bennett, P.L.L.C.

(57) ABSTRACT

A high efficiency vacuum cleaner includes a debris transport passage and a plurality of debris inlets maintained in generally parallel spaced relationship with the floor. The total area of the debris inlets is less than or equal to the minimum cross-sectional area of the debris transport passage. Debris is removed from the floor in an air stream flowing into the debris inlets, the air stream generated by a vacuum source. The debris inlets may be mounted on one or more rotating heads, and the height of the debris inlets over the floor may be adjustable. The rotating heads may be driven by a motor and a belt drive. The belt drive system may be isolated from the airflow carrying the debris.

17 Claims, 4 Drawing Sheets

HIGH EFFICIENCY VACUUM CLEANING APPARATUS AND METHOD

BACKGROUND OF THE INVENTION

The present invention relates generally to the field of vacuum cleaners and specifically to a vacuum cleaning apparatus and method exhibiting a high efficiency in air flow management and utilization.

A broad array of household and industrial vacuum cleaners are known in the art. These machines generally include a vacuum source, such as an electric motor, a debris repository, such as a bag or canister for the collection of debris removed from the floor, and at least one inlet through which debris removed from the floor travels in an air stream to the debris repository. In a common configuration, the vacuum cleaner includes a single large inlet positioned over the floor, with a roller or "beater brush" positioned within the inlet for agitating the surface of the carpet or other floor covering. These types of vacuum cleaners are inefficient at removing debris from the floor, as the large debris inlet area produces a very low airflow velocity. The airflow does not accelerate until it enters the smaller diameter tube or passageway connecting the inlet to the debris receptacle. Additionally, the action of the beater brushes produces unnecessary wear and tear on the carpet.

Another class of floor cleaning machines well known in the art deposit and subsequently remove cleaning fluid. The cleaning fluid, containing dirt and debris from the floor suspended therein, is removed from the floor by a vacuum action and transferred to a fluid recovery receptacle. Many of these floor cleaning machines have the vacuum inlets arranged on one or more rotating heads. The vacuum inlets on such machines, however, are optimized for the recovery of fluids from the floor, and not the direct removal of debris therefrom in an air stream. As such, they are often oriented at an angle other than parallel to the floor, and often contact the floor surface directly—both of which reduce the ability of such machines to remove debris from the floor in an air stream without the use of fluids.

SUMMARY OF THE INVENTION

The present invention, in one aspect, relates to a vacuum cleaner for removing debris from a floor. The vacuum cleaner includes a vacuum source, a debris repository, a plurality of debris inlets that are maintained in spaced relationship to the floor, and a debris transport passage. The debris transport passage has a minimum cross-sectional area that is greater than or equal to the combined area of the debris inlets. The debris transport passage connects the debris inlets to the debris repository and carries debris from the floor in an air stream generated by the vacuum source.

In another aspect, the present invention relates to a method of vacuuming a floor. The method includes maintaining a plurality of debris inlets in spaced relationship over the floor, where the debris inlets are in airflow communication with a debris receptacle via a debris transport passage that has a cross-sectional area not less than the combined area of said debris inlets. Additionally, the method includes generating an air flow, resulting from a vacuum source, from the debris inlets to the debris receptacle, and moving the debris inlets over the floor in a generally parallel orientation with respect to the floor, so as to collect debris from the floor in the maximal velocity air flow.

DETAILED DESCRIPTION OF THE INVENTION

Figure 1A:
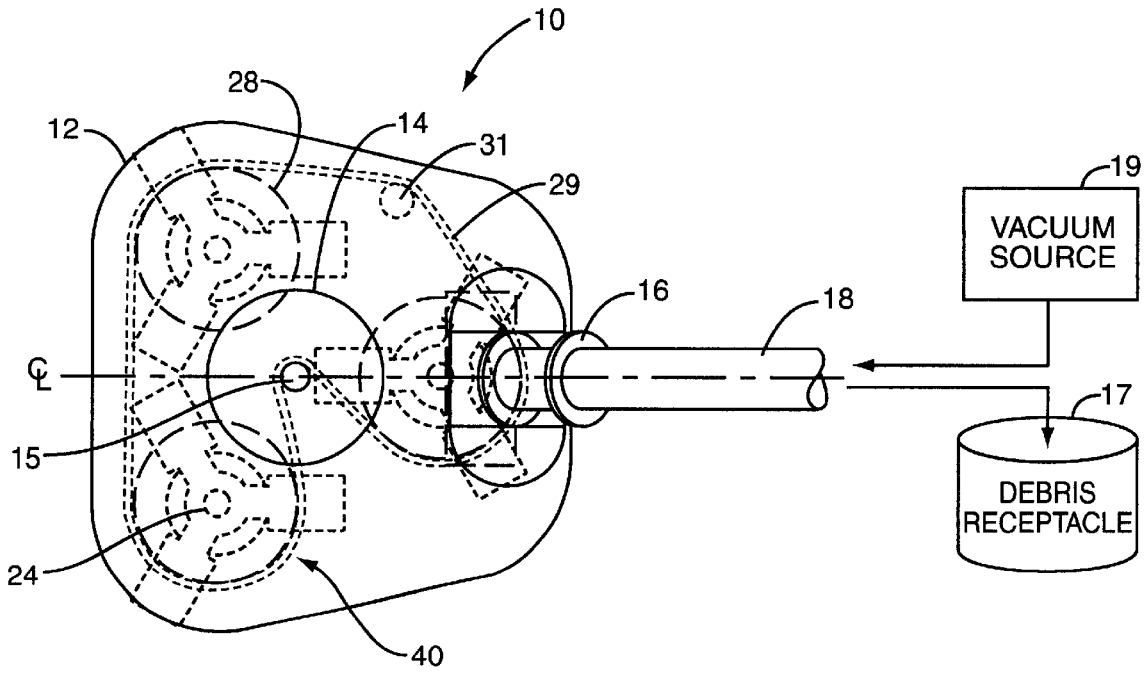
FIGS. 1A and 1B are plan and elevation views of the present invention, respectively.
Figure 1B:
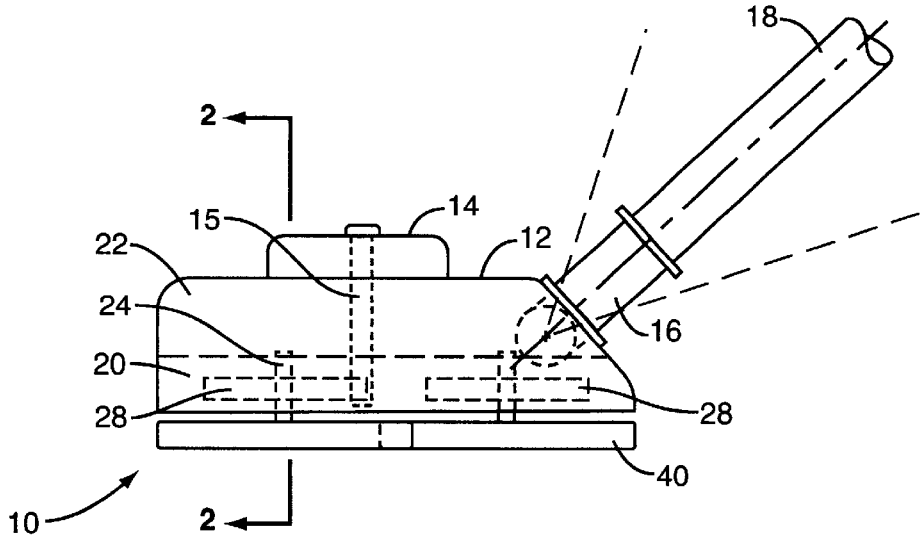

FIGS. 1A and 1B depict top and side views, respectively, of one embodiment of the vacuum cleaner according to the present invention, indicated generally by the numeral 10. The vacuum cleaner 10 includes a housing 12, on which is mounted a motor 14 and an articulated outlet 16. A debris transfer passage, or pipe 18, connects to the articulated outlet 16, and transfers debris removed from the floor in an air stream to a debris receptacle 17, as is well known in the art. The air stream is generated under the influence of a vacuum source 19, which may be a portable unit mounted in association with the chassis 12, or alternatively may be remotely located, providing a vacuum to the chassis 12 through the debris transfer passage 18. The debris transfer passage 18 may additionally function as, or be contained within, the handle by which an operator controls the vacuum cleaner 10.

The motor 14 is operative to cause the rotation of one or more rotating heads 20, such as for example via drive shaft 15. The motor 14 may comprise an electric motor driven by household AC current. Alternatively, the motor 14 may be powered by batteries, and in particular by rechargeable batteries. In another embodiment, the motor 14 may drive the rotating heads 20 by action of the vacuum provided by the vacuum source. As discussed more fully herein, the rotating heads 20 contain debris inlets that remove debris from the floor in an efficient manner.

Figure 2:
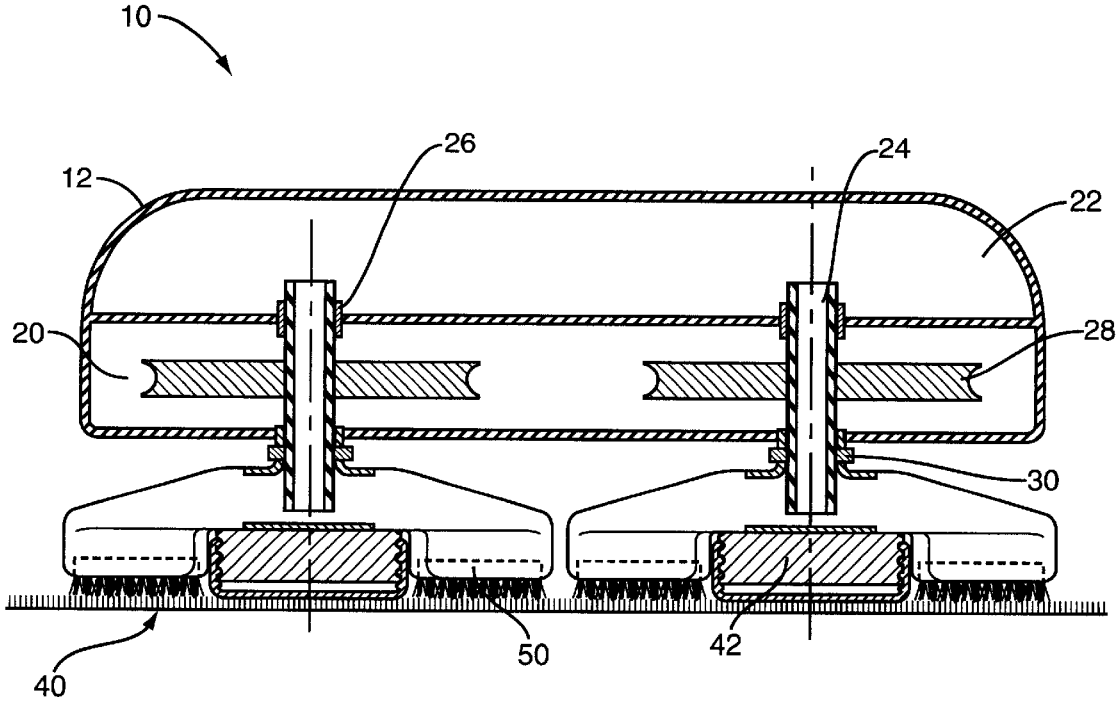
FIG. 2 is a sectional elevation view of the present invention along the section lines indicated in FIG. 1B.

The housing 12 is divided horizontally into a mechanical chamber 20 and a vacuum chamber 22. As depicted in the sectional view of FIG. 2, hollow shafts 24 pass through the mechanical chamber 20, and connect the rotating heads 20 with the vacuum chamber 22. The hollow shafts 24 are permanently affixed within the housing 12, and connected to sealed bearings 26 where they pass through the partition separating the mechanical chamber 20 from the vacuum chamber 22. Also connected to the hollow shafts 24 are snap rings 30, allowing for removal of the rotating heads 40. Drive pulleys 28 are affixed to each hollow shaft 24. The drive pulleys 28 may be driven by a belt drive 29 (see FIG. 1A), which may be driven by the electric motor 14, such as via drive shaft 15 (see FIG. 1B) extending into the mechanical chamber 20. Alternatively, the drive pulleys 28 could comprise sprockets, driven by a chain drive. In either embodiment, a belt or chain tensioner 31 may be employed to maintain tension on the belt or chain within a predetermined range. Intermeshing gears, worm gear drives, and a broad array of similar rotational drive means, as are well known in the mechanical arts, may additionally be employed to impart rotational movement to the rotating heads 40, within the scope of the present invention.

According to the present invention, the rotary drive mechanisms and components in the mechanical chamber 20 are separated from the path of debris removal, and are thus not exposed to the dust, debris, and other objects removed from the floor. The debris removal path begins with a plurality of debris inlets 46 contained on rotating heads 40. The debris inlets 46 are in airflow communication, through hollow rotating shafts 24, with the vacuum chamber 22. The vacuum chamber 22, in turn, is in airflow communication with the articulated outlet 16, to which is attached the debris transfer passage 18 leading to the debris receptacle.

Figure 3A:
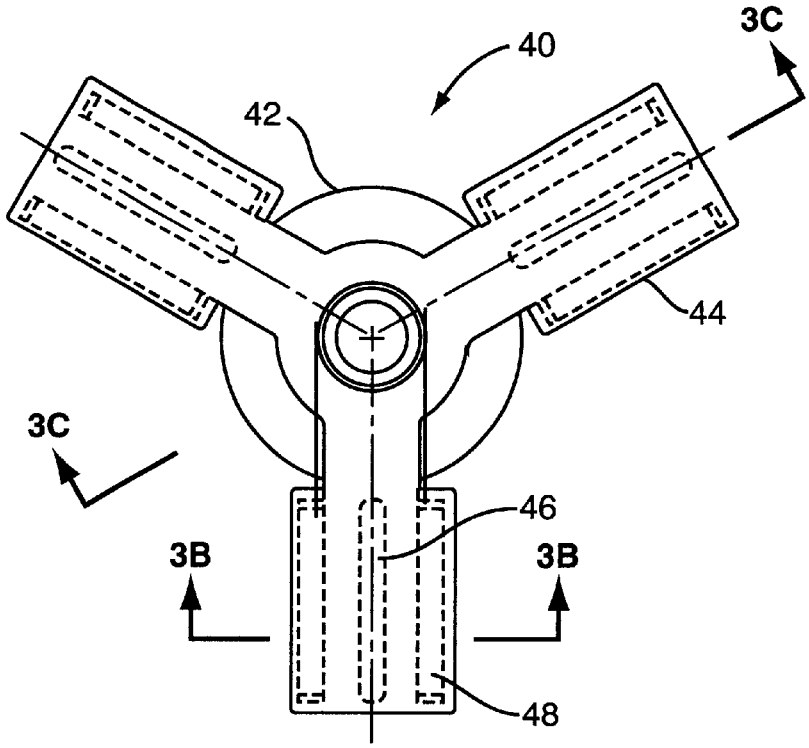
FIG. 3A is a plan view of one of the rotating heads of the present invention.
Figure 3B:
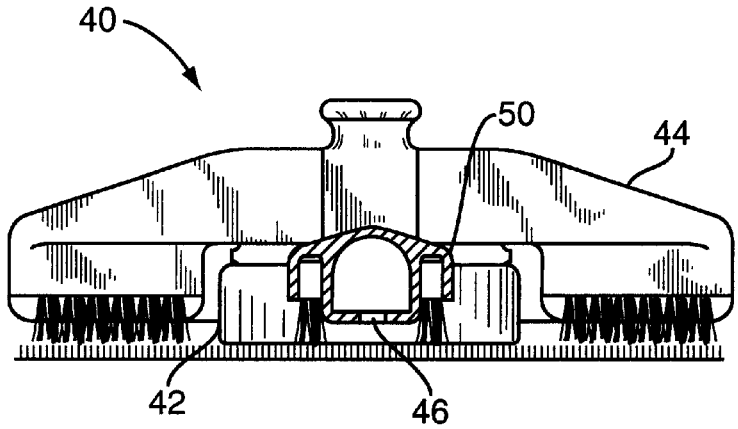
FIGS. 3B and 3C are sectional elevation views of portions of the rotating head of FIG. 3A, along the section lines indicated.
Figure 3C:
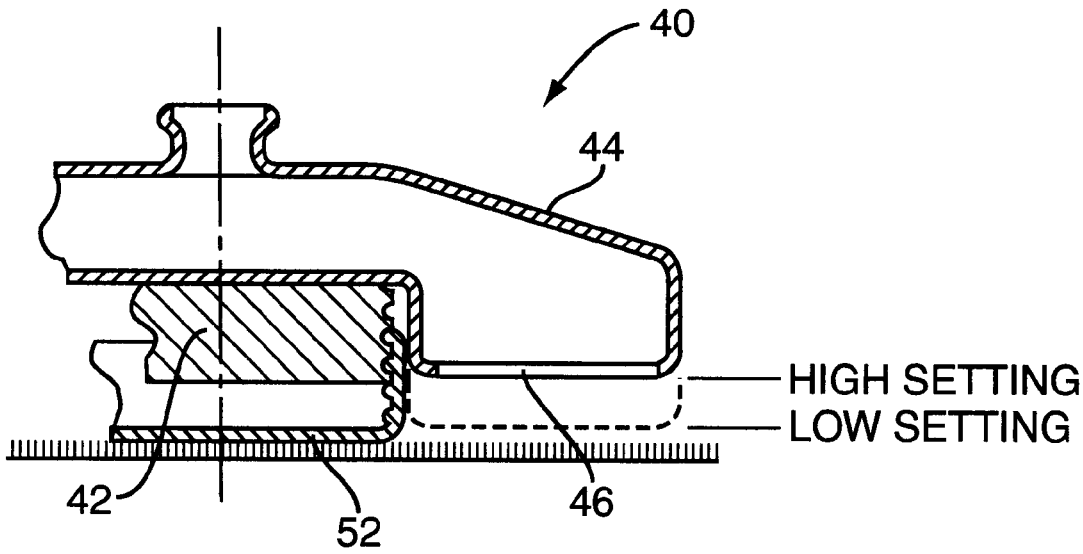

The structure and operation of the rotating heads 40 are depicted in FIGS. 3A, 3B, and 3C. The rotating head 40 includes a central hub 42, to which are connected a plurality of arms 44. Each arm 44 includes a debris inlet 46, in a position parallel to the floor and generally radially aligned on the rotating head 40. Proximate the debris inlet 46, on either side thereof, are brush receptacle chambers 48, which may accept agitator brush inserts 50. The brush inserts 50 are easily inserted and/or removed by the user, to adapt the vacuum cleaner 10 to a broad array of floor types.

In one embodiment of the present invention, a height adjustment cap 52 is threadedly connected to the hub 42 of each rotating head 40. By turning the height adjustment cap 52 with respect to the hub 42, the height of the debris inlets 46 above the floor may be adjusted. A detent latching mechanism may be included, operative to restrict the positioning of the height adjustment cap 52 on the hub 42 to a plurality of predefined positions, such as for example, high, medium, and low. Regardless of whether a height adjustment cap 52 is utilized, the rotating head 40 maintains the debris inlets 46 in spaced relation above the surface of the floor, and in a generally horizontal position with respect thereto. In this position, the airflow generated around the debris inlets 46 is oriented so as to provide maximum debris removal efficiency directly below the debris inlets 46, such as for removing debris from deep within carpet. The spacing relative to the floor additionally prevents the debris inlets 46 from contacting the floor, which would clog the debris inlets 46 and essentially nullify their ability to remove debris from the carpet.

According to the present invention, the combined area of all debris inlets 46 is less than or equal to the minimum cross-sectional area of the most restrictive region of air flow through the vacuum cleaner 10, which in most cases is the debris transport passage 18. This limitation ensures that the maximum possible air velocity is generated at the debris inlets 46, providing for the most efficient collection of debris from the floor. If the combined area of debris inlets 46 exceeds the minimum cross-section area of the debris transport passage 18, then the air velocity at the debris inlet 46 is reduced, and the air flow experiences an acceleration at some point along its path to the debris receptacle where the restriction to the minimum cross-section area occurs, such as is the case in prior art vacuum cleaners.

By way of example and without limitation, assume a vacuum cleaner 10 with a debris transport tube 18 having a diameter of 1.25 inches, or a cross-sectional area of 1.24 $in^2$. The provision of three rotating heads 40, each including three debris inlets 46, yields a maximum allowable area per debris inlet 46 of 0.14 $in^2$. A debris inlet 46 that is 0.125 in. wide would thus be approximately 1.10 in. long.

Figure 4:
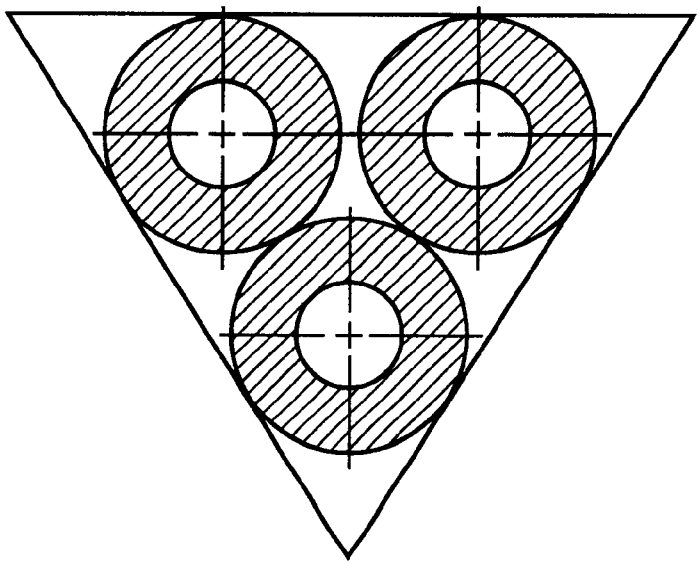
FIG. 4 is a schematic diagram mapping out the swept vacuum area of the present invention.

In operation, a vacuum source is applied to the debris transport passage 18, creating an airflow therethrough towards the debris receptacle. The vacuum is transferred to the vacuum chamber 22, the hollow shafts 24, and the radial arms 44 of the rotating heads 40. In response thereto, a stream of flowing air, carrying debris from the floor, enters the debris inlets 46 at the maximum possible velocity due to the inlet area being less than or equal to the minimum cross-section area of air flow in the, system. The air stream travels through the radial arm 44, through the hollow shafts 24 into the vacuum chamber 22, and thence through the articulated outlet 16 and the debris transport passage 18 to a debris receptacle. Meanwhile, under power from the electric motor 14, a conventional belt drive system within the drive mechanism chamber 20 turns the drive pulleys 28, such as at a rotational speed of approximately 50–100 revolutions per minute. This causes the hollow shafts 24 to rotate within the sealed bearings 26, turning each of the rotating heads 40 about its axis. The rotating heads 40 spin over the floor, with the hub 42 or, if provided, the height adjustment cap 52, in direct contact with the floor, and the radial arms 44 spaced a short distance over the floor. The debris inlets 46, arranged on radial arms 44, thus sweep out a circular pattern over the floor, as depicted by the diagram of FIG. 4. The brushes 50, if present, provide agitation to the floor that further assists the efficiency of debris removal therefrom. The user then simply moves the vacuum cleaner 10 over the area of floor to be cleaned.

As used herein, the term "vacuum" denotes a pressure sufficiently less than the ambient air pressure to generate airflow capable of removing debris therein. The term vacuum does not require the complete absence of matter. By way of example and without limitation, a vacuum generated by the present invention may be on the order of 20–150 inches waterlift, with a resulting airflow on the order of 30–200 $ft^3$/min.

As used herein, the term "floor" denotes a generally flat surface on which one may walk, and is to be construed broadly. For example and without limitation, the term "floor" includes wood, tile, slate, ceramic, concrete, and cement surfaces, as well as artificial surfaces designed to replicate or simulate any of these. The floor may be covered with carpet, rugs, a laminate protective covering such as FORMICA®, or similar covering. The floor may be interior or exterior to a building, and may include the walking surface of a stage, gymnasium, tennis court, patio, sidewalk, or the like, as well as the walking surface of a room.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A vacuum cleaner for removing debris from a floor, comprising:

a vacuum source;

a debris repository;

a plurality of debris inlets maintained in spaced relationship to the floor and generally parallel thereto, said debris inlets having a combined area; and a debris transport passage, having a minimum cross-sectional area, connecting said debris inlets to said debris repository and carrying debris from the floor therein in an air stream generated by said vacuum source;

wherein said combined area is not greater than said minimum cross-sectional area.

2. The vacuum cleaner of claim 1, wherein said plurality of debris inlets are disposed on at least one rotating head, said rotating head operative to sweep said debris inlets in a generally circular pattern over the floor.

3. The vacuum cleaner of claim 2, wherein said rotating head includes a floor contact surface at the center thereof, said floor contact surface adjustably coupled to said rotating head such that said debris inlets are maintained over the floor at a height determined by the adjustment of said coupling.

4. The vacuum cleaner of claim 3, where said adjustable coupling comprises a threaded coupling whereby the height of said debris inlets over the floor is adjusted by rotating said floor contact surface with respect to said rotating head.

5. The vacuum cleaner of claim 4, further comprising a detent latching mechanism operative to restrict the relative rotation between said floor contact surface and said rotating head to rotation between predetermined positions.

6. The vacuum cleaner of claim 2, wherein said vacuum cleaner includes at least two said rotating heads, each said rotating head containing at least one said debris inlet.

7. The vacuum cleaner of claim 6, wherein said vacuum cleaner includes three said rotating heads in a generally triangular configuration, each said rotating head containing three said debris inlets.

8. The vacuum cleaner of claim 6, further comprising an electric motor, and wherein one or more of said at least two rotating heads are driven by a belt drive system, said belt drive system driven by said electric motor.

9. The vacuum cleaner of claim 1, wherein said plurality of debris inlets maintained in spaced relationship to the floor are maintained generally parallel to the floor.

10. A method of vacuuming a floor, comprising:

maintaining a plurality of debris inlets in spaced relationship over the floor in a generally parallel orientation, said debris inlets in air flow communication with a debris receptacle via a debris transport passage having a cross-sectional area not less than the combined area of said debris inlets;

generating an air flow from said debris inlets to said debris receptacle, said air flow resulting from a vacuum source; and moving said debris inlets over the floor, in a generally parallel orientation with respect to the floor, so as to collect debris from the floor in said air flow.

11. The method of claim 10, further comprising adjusting the height of said debris inlets over the floor prior to moving said debris inlets over the floor.

12. The method of claim 10, further comprising providing a brush proximate at least one said debris inlet, said brush operative to agitate debris on the floor.

13. The method of claim 10, wherein moving said debris inlets over the floor comprises moving said debris inlets in at least one generally circular path by rotating at least one rotating head, each said rotating head containing at least one said debris inlet.

14. A vacuum cleaner, comprising a debris transport passage having a minimum cross-sectional area, operative to remove debris in an air stream generated by a vacuum source;

an internally segmented housing, defining a vacuum chamber in airflow relationship with said debris transport passage and a mechanical chamber substantially sealed from said vacuum chamber;

at least one rotating head including at least one debris inlet maintained in generally parallel spaced relationship to the floor, wherein the total area of all said debris inlets is not greater than said minimum cross-sectional area, each said rotating head in airflow relationship with said vacuum chamber via a hollow shaft connected to said rotating head and passing through said mechanical chamber, such that debris removed from the floor by an air stream flowing into said debris inlet is transported out through said debris transport passage; and drive means within said mechanical chamber for rotating each said rotating head about its axis.

15. The vacuum cleaner of claim 14 wherein said drive means comprises a belt drive, and wherein a pulley driven by said belt drive is affixed to each said tube, rotating each said rotating head about its axis.

16. The vacuum cleaner of claim 15, wherein said belt drive includes a belt tensioner.

17. The vacuum cleaner of claim 14, further comprising a motor operative to actuate said drive means.

* * * * *